US008820272B2

(12) United States Patent
Terry et al.

(10) Patent No.: US 8,820,272 B2
(45) Date of Patent: Sep. 2, 2014

(54) COOLING SYSTEM HAVING SHOCK REDUCING VALVE

(71) Applicant: Caterpillar Inc., Peoria, IL (US)

(72) Inventors: Neil Alan Terry, Edelstein, IL (US); James Carl Durand, Dunlap, IL (US); Joseph Lee Kennedy, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/691,127

(22) Filed: Nov. 30, 2012

(65) Prior Publication Data

US 2014/0150738 A1 Jun. 5, 2014

(51) Int. Cl.

| | |
|---|---|
| ***F01P 1/08*** | (2006.01) |
| ***F01P 11/20*** | (2006.01) |
| *F02N 19/10* | (2010.01) |
| *F01P 7/14* | (2006.01) |

(52) U.S. Cl.

CPC ..... *F01P 11/20* (2013.01); *F01P 2011/205* (2013.01); *F02N 19/10* (2013.01); *F01P 2007/146* (2013.01); *F01P 2060/08* (2013.01)

USPC ..... 123/41.14

(58) Field of Classification Search

USPC ..... 123/41.1, 41.14

See application file for complete search history.

(56) References Cited

U.S. PATENT DOCUMENTS

| | | | | |
|---|---|---|---|---|
| 3,211,374 | A * | 10/1965 | Matulaitis | 237/8 R |
| 3,265,048 | A * | 8/1966 | Herbon | 123/41.14 |
| 4,273,081 | A | 6/1981 | Cleveland et al. | |
| 4,300,718 | A | 11/1981 | Beyer | |
| 4,484,541 | A | 11/1984 | Yokoyama | |
| 4,964,371 | A | 10/1990 | Maeda et al. | |
| 5,404,842 | A | 4/1995 | Matsushiro et al. | |
| 5,730,089 | A * | 3/1998 | Morikawa et al. | 123/41.14 |
| 6,032,869 | A | 3/2000 | Ito et al. | |
| 6,532,807 | B1 | 3/2003 | Krauss | |
| 7,370,612 | B2 | 5/2008 | Hanai | |
| 7,735,461 | B2 * | 6/2010 | Vetrovec | 123/41.14 |
| 2004/0107922 | A1 | 6/2004 | Roth | |
| 2009/0205590 | A1 * | 8/2009 | Vetrovec | 123/41.14 |
| 2009/0301409 | A1 | 12/2009 | Dahl et al. | |

FOREIGN PATENT DOCUMENTS

| | | |
|---|---|---|
| JP | 10-317967 | 12/1998 |

* cited by examiner

*Primary Examiner* — Lindsay Low
*Assistant Examiner* — Charles Brauch
(74) *Attorney, Agent, or Firm* — Finnegan, Henderson, Farabow, Garrett & Dunner LLP

(57) ABSTRACT

A cooling system for an engine includes a pump driven by the engine and configured to circulate coolant through the engine. The cooling system also includes a heat exchanger configured to receive coolant from the engine and to reduce a temperature of the coolant. The cooling system further includes a thermostat fluidly connected to the engine and the heat exchanger. The thermostat is configured to selectively direct coolant from the engine to the heat exchanger when a temperature of the coolant is greater than a temperature threshold of the thermostat. The thermostat is also configured to substantially block coolant from passing to the heat exchanger when the temperature of the coolant is less than or equal to the temperature threshold. The cooling system also includes a valve fluidly connected to the engine and the heat exchanger, and connected in parallel with the thermostat. The valve is configured to direct a portion of the coolant exiting the engine to the heat exchanger during a first operating condition. During the first operating condition, a pressure of the coolant exiting the engine is greater than a pressure threshold of the valve.

20 Claims, 7 Drawing Sheets

COOLING SYSTEM HAVING SHOCK REDUCING VALVE

TECHNICAL FIELD

The present disclosure relates generally to a cooling system and, more particularly, to a cooling system having a shock reducing valve.

BACKGROUND

Engines, including diesel engines, gasoline engines, and gaseous fuel-powered engines are used to generate mechanical, hydraulic, or electrical power. In order to accomplish this power generation, an engine typically combusts a fuel/air mixture. With the purpose of ensuring optimum combustion of the fuel/air mixture and protecting components of the engine from extreme temperatures, the temperature of the engine must be tightly controlled.

An internal combustion engine is generally fluidly connected to one or more heat exchangers to cool liquids circulated throughout the engine. These heat exchangers are often located close together, and/or close to the engine, to conserve space on the machine. An engine-driven fan may be disposed in front of the engine and heat exchanger to blow air across the heat exchanger and the engine. Alternatively, the engine-driven fan may be disposed between the engine and heat exchanger to draw air past the exchangers and blow air past the engine. The airflow removes heat from the heat exchangers and the engine.

In current engine cooling systems, a thermostat having a temperature-sensitive flow control element may be used to regulate the flow of coolant from the engine to the heat exchanger. For example, when the temperature of the engine exceeds a threshold of the thermostat, the flow control element expands to open a valve, thereby allowing communication between the engine and the heat exchanger. Since the hot coolant from the engine typically has a much higher temperature than the heat exchanger, the coolant suddenly entering the heat exchanger can cause a thermal shock that induces a strain on the heat exchanger. This strain can result in cracking of the heat exchanger, thereby shortening the lifespan of the heat exchanger and/or compromising the effectiveness of the heat exchanger.

An exemplary cooling system is described in U.S. Pat. No. 4,964,371 (the '371 patent) issued to Maeda et al. on Oct. 23, 1990. The '371 patent describes an engine cooling system comprising two temperature-regulated valves that selectively open or close a bypass passage based on coolant temperature. This mechanism allows coolant to either flow through a heat exchanger or to flow back to the engine without travelling to the heat exchanger. The opening and closing of one of the valves is additionally regulated by changes in air pressure, which vary based on changes in engine load conditions. This valve is controlled so that it closes at low engine loads regardless of temperature. In this manner, an amount of coolant passing through the heat exchanger can be varied based on engine loading.

Although the '371 patent discusses varying coolant flow dependent on changing engine load conditions, it may not adequately reduce thermal strain at all loading conditions. Specifically, the system taught in the '371 patent may still allow hot coolant returning from the engine to suddenly flow through the two valves to the heat exchanger at high engine load. Accordingly, shock loading can be experienced by the heat exchanger during operation of the engine.

The disclosed cooling system is directed to overcoming one or more of the problems set forth above and/or other problems of the prior art.

SUMMARY

In one aspect, the present disclosure is directed to a cooling system for an engine. The cooling system includes a pump driven by the engine and configured to circulate coolant through the engine. The cooling system also includes a heat exchanger configured to receive coolant from the engine and to reduce a temperature of the coolant. The cooling system further includes a thermostat fluidly connected to the engine and the heat exchanger. The thermostat is configured to selectively direct coolant from the engine to the heat exchanger when a temperature of the coolant is greater than a temperature threshold of the thermostat. The thermostat is also configured to substantially block coolant from passing to the heat exchanger when the temperature of the coolant is less than or equal to the temperature threshold. The cooling system also includes a valve fluidly connected to the engine and the heat exchanger, and connected in parallel with the thermostat. The valve is configured to direct a portion of the coolant exiting the engine to the heat exchanger during a first operating condition. During the first operating condition, a pressure of the coolant exiting the engine is greater than a pressure threshold of the valve.

In another aspect, the present disclosure is directed to a cooling system for an engine. The cooling system includes a pump driven by the engine and configured to circulate coolant through the engine. The cooling system also includes a heat exchanger configured to receive coolant from the engine and to reduce a temperature of the coolant. The cooling system further includes a thermostat fluidly connected to the engine, the pump, and the heat exchanger. The thermostat is configured to simultaneously direct coolant from the engine to the heat exchanger, while substantially blocking passage of coolant from the engine to the pump when a temperature of the coolant is greater than a temperature threshold of the thermostat. The cooling system also includes a valve fluidly connected to the engine and the heat exchanger, and connected in parallel with the thermostat. The valve is configured to direct a portion of the coolant exiting the engine to the heat exchanger when a pressure of the coolant is greater than a pressure threshold of the valve. The valve is also configured to substantially block passage of coolant to the heat exchanger when the pressure of the coolant is less than or equal to the pressure threshold.

In yet another aspect, the present disclosure is directed to a method of cooling an engine. The method includes receiving heated coolant from the engine. The method also includes directing a portion of the coolant from the engine to a heat exchanger during a first operating condition, in response to a pressure of the coolant being greater than a threshold pressure. The method further includes directing a remainder of the coolant to a pump during the first operating condition, in response to a temperature of the coolant being less than or equal to a threshold temperature.

DETAILED DESCRIPTION

Figure 1:
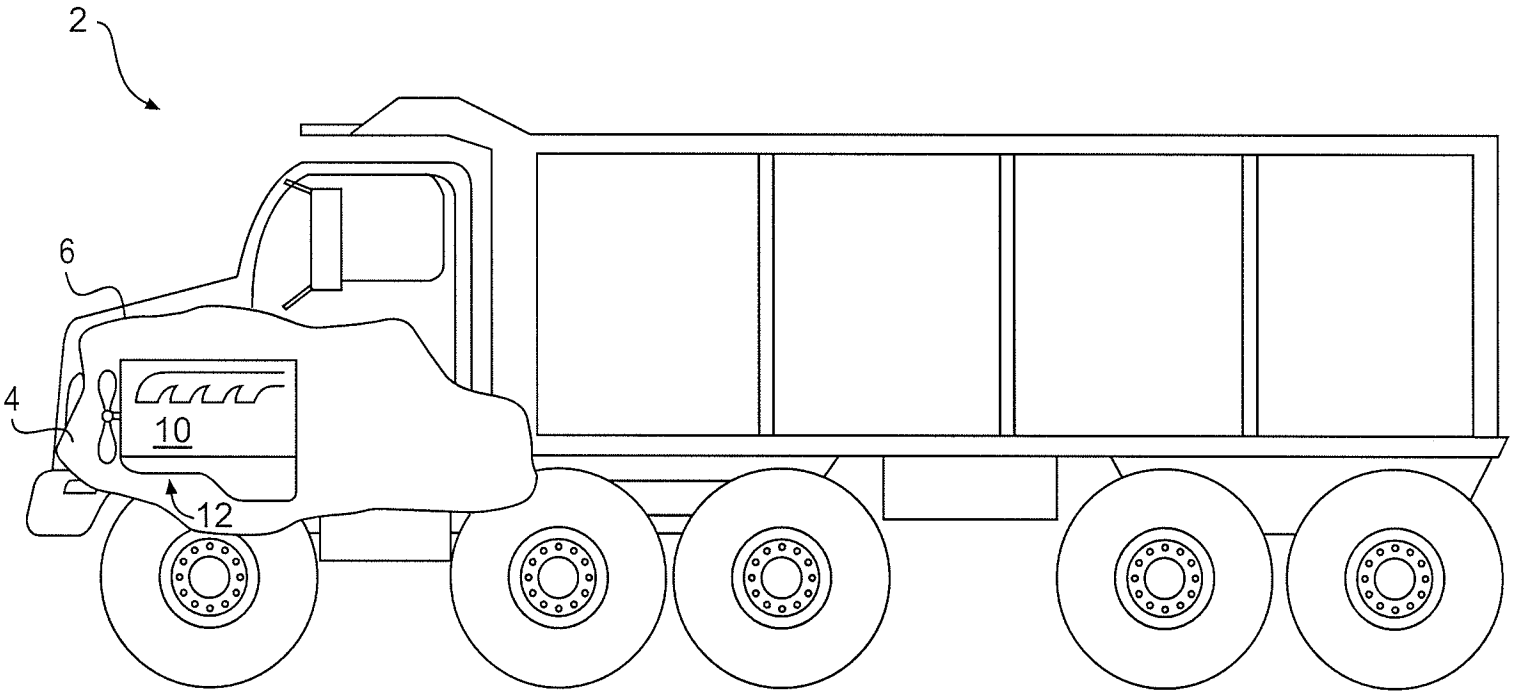
FIG. 1 is a pictorial illustration of an exemplary disclosed machine.

FIG. 1 illustrates an exemplary disclosed machine 2. Machine 2 may be a stationary or mobile machine that performs various operations associated with an industry such as mining, construction, farming, power generation, or any other industry known in the art. For example, machine 2 may embody an earth moving machine such as a haul truck (shown in FIG. 1), a dozer, a loader, a backhoe, an excavator, a motor grader, or any other suitable earth moving machine. Alternatively, machine 2 may be associated with electric power generation, fluid (e.g., oil, water, gas, etc.) pumping, or another stationary application, if desired.

In the disclosed embodiment, machine 2 may include a frame 4 that supports an engine 10 and a cooling system 12 within an enclosure 6. Enclosure 6 may embody a removable cowling having one or more air inlets that allow air flow through at least a portion of enclosure 6 for cooling purposes.

Engine 10 may include multiple components that cooperate to produce a power output. In particular, the engine 10 may include an engine block that defines a plurality of cylinders, a piston slidably disposed within each cylinder, and a cylinder head associated with each cylinder (not shown). One skilled in the art will recognize that the engine 10 may be any type of internal combustion engine such as, for example, a two- or four-stroke diesel, gasoline, or gaseous fuel-powered engine. The combination of a cylinder, associated piston, and associated cylinder head may form a combustion chamber. In one embodiment, the engine 10 may include four combustion chambers. However, it is contemplated that the engine 10 may include any number of combustion chambers and that the combustion chambers may be disposed in an "in-line" configuration, a "V" configuration, or any other suitable configuration.

Figure 2:
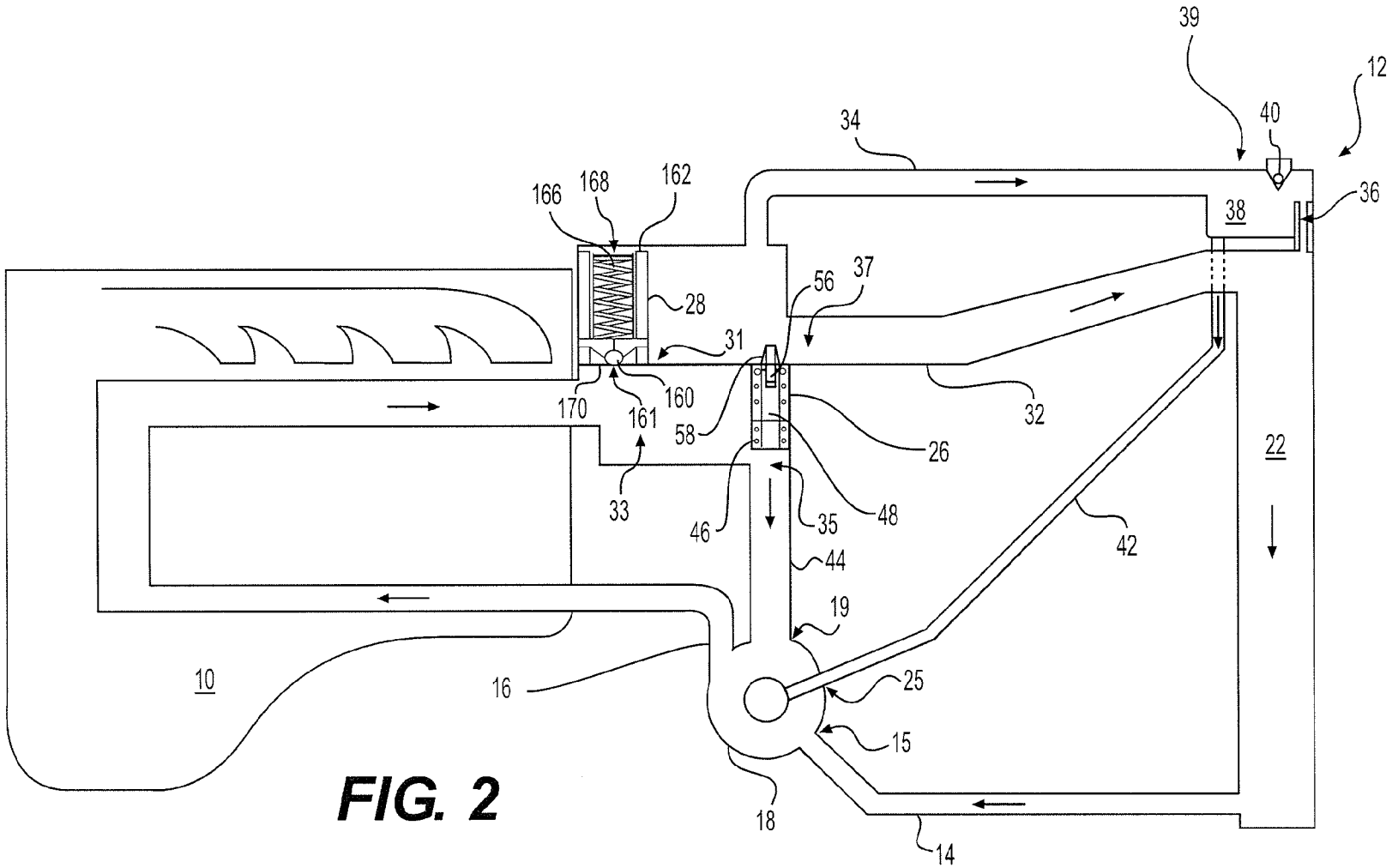
FIG. 2 is a schematic illustration of an exemplary disclosed engine cooling system that may be used in conjunction with the machine of FIG. 1.

As shown in FIG. 2, the cooling system 12 may include components that cooperate to cool fluids such as coolant directed to and/or from the engine 10. It is contemplated that the coolant may comprise water, glycol, a water/glycol mixture, or any other fluid commonly used in cooling systems. The cooling system 12 may include a thermostat 26, a heat exchanger 22, and a flow passage 32 fluidly connected to the heat exchanger 22 and the thermostat 26. The cooling system 12 may further include a pump 18, a bypass passage 44 fluidly connected to the thermostat 26 and the pump 18, and a flow passage 14 fluidly connected to the pump 18 and the heat exchanger 22. As shown in FIG. 2, the pump 18 may have a first inlet 15 fluidly connected to flow passage 14, a second inlet 19 fluidly connected to bypass passage 44, and a third inlet 25 fluidly connected to a shunt line 42 of a shunt system 39. Shunt system 39 will be described in greater detail below.

Additionally, the cooling system 12 may include an inlet passage 33 fluidly connected with the engine 10, and configured to receive heated coolant from the engine 10. In exemplary embodiments, inlet passage 33 may comprise a fluid channel, manifold, and/or other like fluid handling component, and the thermostat 26 may be disposed within and/or otherwise fluidly connected to inlet passage 33. In exemplary embodiments, the fluid connection between inlet passage 33 and thermostat 26 may enable thermostat 26 to at least partially control fluid communication between engine 10 and other downstream components of cooling system 12. For example, as will be described in greater detail below, thermostat 26 may be configured to at least partially control fluid communication between engine 10, via inlet passage 33, and at least one of pump 18 and heat exchanger 22.

The cooling system 12 may further include a shock reducing valve 28 fluidly connected to inlet passage 33. As shown in FIG. 2, shock reducing valve 28 may also be fluidly connected to flow passage 32 by way of a flow passage 31 that is fluidly separate from inlet passage 33. It is contemplated that, in further embodiments, cooling system 12 may include additional and or/different components such as, for example, an exhaust cooler, one or more additional valves, flow meters, and/or other cooling system components known in the art.

Figure 3:
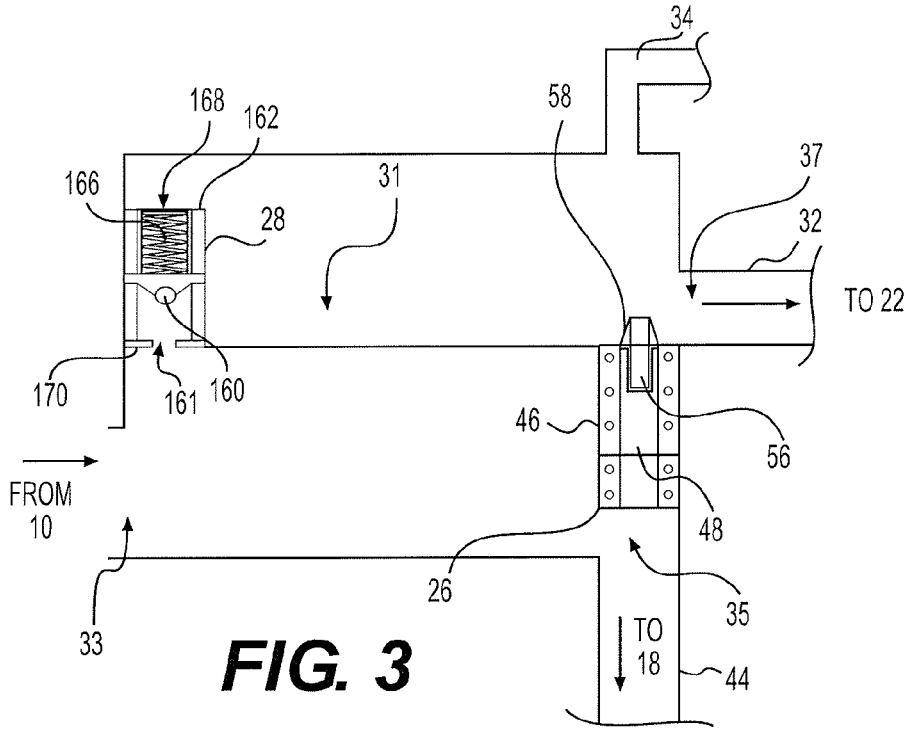
FIGS. 3-4 are cross-sectional illustrations of an exemplary disclosed valve and thermostat assembly that may be used in conjunction with the cooling system of FIG. 2.
Figure 4:
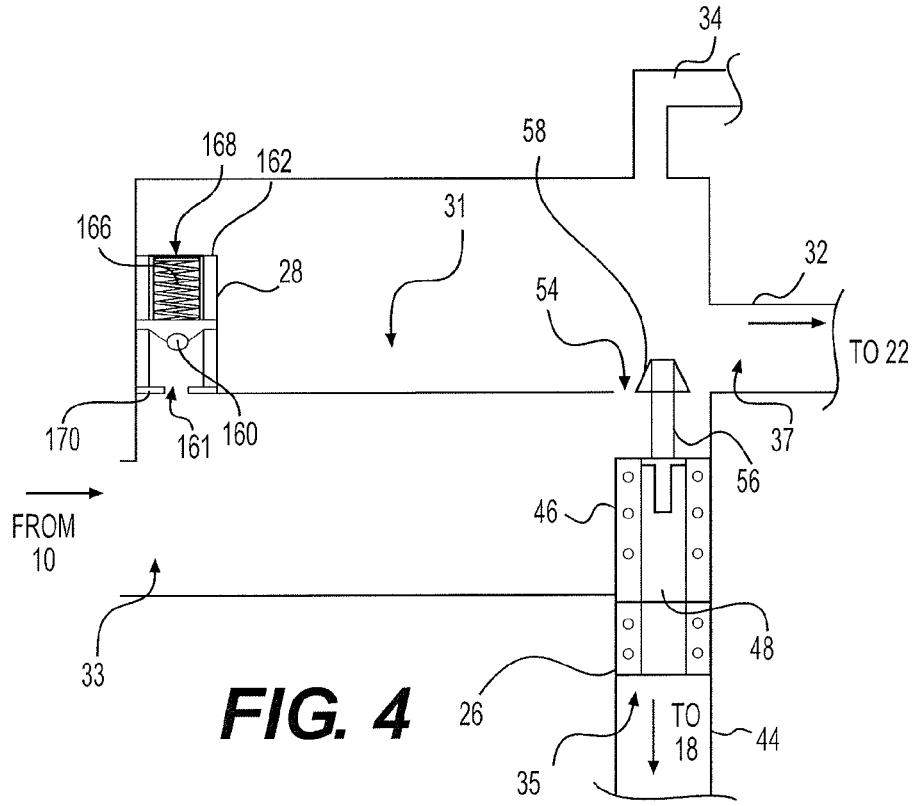

Thermostat 26 may be configured to direct a heated flow of coolant from the engine 10 to the heat exchanger 22. In exemplary embodiments, the thermostat 26 may be configured to selectively fluidly connect the engine 10 and the heat exchanger 22 based on a temperature of the coolant received from the engine 10. For example, as will be described in greater detail below, when a temperature of the coolant received from the engine 10 is less than or equal to a threshold temperature of the thermostat 26, such coolant may be prohibited from passing from inlet passage 33 into flow passage 32 by way of the thermostat 26. Such a configuration is shown in FIGS. 2 and 3, and may be referred to herein as a "first flow-blocking position" of thermostat 26. On the other hand, when a temperature of such coolant is greater than the threshold temperature, the thermostat 26 may be configured to permit such coolant to pass from inlet passage 33 into flow passage 32 by way of a flow passage inlet 37. Such a configuration is shown in FIG. 4, and may be referred to herein as a "second flow-blocking position" of thermostat 26. The thermostat 26 may also be configured to selectively fluidly connect the engine 10 and the pump 18 based on the temperature of the coolant received from the engine. For example, when the temperature of the coolant received from the engine 10 is less than or equal to the threshold temperature, the thermostat 26 may be arranged in the first flow-blocking position described above, and may be configured to permit such coolant to pass from inlet passage 33 into bypass passage 44. On the other hand, when a temperature of such coolant is greater than the threshold temperature, the thermostat 26 may be arranged in the second flow-blocking position described above, and may be configured to prohibit such coolant from passing from inlet passage 33 into bypass passage 44.

As shown in FIGS. 2-4, thermostat 26 may include one or more of a temperature-sensitive pellet 48, a flow element 46 moveable in response to expansion and/or contraction of pellet 48, a pin 56 substantially centrally disposed within thermostat 26 and configured to guide movement of flow element 46, and a top 58 connected to the pin 56. In exemplary embodiments, the pin 56, may be secured to the top 58, and the top 58 may be coupled and/or otherwise connected to inlet passage 33. It is contemplated that the pellet 48 may be made of temperature-sensitive materials having desired thermal expansion properties. The pellet 48 may made from, for example, wax and/or other like materials configured to expand in response to an increase in temperature and contract in response to a decrease in temperature. Expansion of pellet 48 may cause flow element 46 to slide along pin 56 in the direction of bypass passage 44 and/or away from top 58. Such movement of flow element 46 may result in thermostat 26 fluidly disconnecting inlet passage 33 from bypass passage 44, and may transition thermostat 26 to the second flow-blocking position described above. Such a transition may expose one or more openings 54 (FIG. 4) of the thermostat 26 proximate the top 58 and fluidly connecting inlet passage 33 with flow passage 32. On the other hand, contraction of pellet 48 may cause flow element 46 to slide along pin 56 in the direction of top 58 and/or opposite bypass passage 44. Such movement of flow element 46 may result in thermostat 26 fluidly connecting inlet passage 33 to bypass passage 44, and may transition thermostat 26 to the first flow-blocking position described above.

In exemplary embodiments, thermostat 26 may comprise a variable flow control valve and/or other like variable flow control device. In such embodiments, thermostat 26 may be configured to achieve and/or maintain any number of intermediate positions between the first and second flow-blocking positions described above. In such intermediate positions, flow element 46 may be disposed at any position along pin 56 to increase, decrease and/or otherwise variably control fluid communication between inlet passage 33, and passages 44, 32. It is understood that, in some configurations of thermostat 26, fluid communication between inlet passage 33, and passages 44, 32 may be simultaneously controlled by movement of flow element 46. In such embodiments, for example, an increase in flow from inlet passage 33 to flow passage 32 via thermostat 26 may result in a corresponding and simultaneous decrease in flow from inlet passage 33 to bypass passage 44 via thermostat 26. Alternatively, in further exemplary embodiments, thermostat 26 may comprise a non-variable, on/off-type flow control valve and/or other like flow control device. In such embodiments, thermostat 26 may be configured to transition between the first and second flow-blocking positions described above substantially instantaneously, without maintaining any of the intermediate positions described above. It is contemplated that the threshold temperature of the thermostat 26 may comprise a melting point of pellet 48, and may be any desired temperature commonly achieved by engine coolant. For example, such a threshold temperature may be between approximately 50 degrees Celsius and approximately 100 degrees Celsius. In still further embodiments, such a threshold temperature may be between approximately 80 degrees Celsius and approximately 90 degrees Celsius.

With continued reference to FIG. 2, heat exchanger 22 may embody a main radiator (i.e., a high temperature radiator) of engine 10 and may be configured to dissipate heat from coolant circulating through and heated by engine 10. In one embodiment, engine 10 may be employed in a marine setting, for example as a prime mover or electrical power generator of a marine vessel. In such embodiments, heat exchanger 22 may be a liquid-to-liquid type of exchanger configured to draw in water from the marine environment, and transfer heat from the pressurized coolant to the water. Alternatively, heat exchanger 22 may embody a liquid-to-air type of exchanger, if desired. A liquid-to-air heat exchanger may include a tube and shell-type heat exchanger, a plate-type heat exchanger, or any other type of heat exchanger known in the art. The heat exchanger 22 may cool the coolant to at or below a predetermined operating temperature of the engine 10. In exemplary embodiments, such an operating temperature may be between approximately 50 degrees Celsius and approximately 100 degrees Celsius. In still further embodiments, such a temperature may be between approximately 80 degrees Celsius and approximately 90 degrees Celsius.

Pump 18 may be an engine-driven centrifugal pump configured to pressurize coolant within the cooling system 12. For example, pump 18 may be configured to direct pressurized coolant into the engine 10 via a returning passage 16 fluidly connected to pump 18 and engine 10. In exemplary embodiments, pump 18 may include one or more impellers (not shown) disposed within a volute housing (not shown). Such impellers may be configured to selectively draw in coolant from the heat exchanger 22, via flow passage 14, and to pressurize the coolant received from the heat exchanger 22. The pump 18 may also be configured to receive additional coolant from the shunt line 42 and/or the bypass passage 44, and to pressurize such coolant. As coolant enters pump 18 via first inlet 15, second inlet 19, and/or third inlet 25, blades of the impeller may be rotated by operation of engine 10 to push against the coolant, thereby pressurizing the coolant. An input torque imparted by engine 10 to pump 18 may be related to a resulting pressure of the coolant, while a speed at which pump 18 is driven by engine 10 may be related to a resulting flow rate of the coolant. The speed at which pump 18 is driven may also be related to a resulting temperature of the coolant. For example, in one embodiment, pump speed may be directly proportional to the absolute temperature of the coolant exiting pump 18 and passing through returning passage 16. In such an embodiment, for example, a relatively high pump speed may limit the dwell time of coolant within heat exchanger 22, and thus, may limit the reduction in coolant temperature affected by heat exchanger 22. It is contemplated that pump 18 may alternatively embody a piston-type pump, if desired, and may have a variable or constant displacement.

With continued reference to FIG. 2, shunt system 39, fluidly connected to pump 18 via shunt line 42, may include one or more of an engine vent line 34, a shunt inlet 36, a shunt tank 38, and a shunt valve 40 fluidly connected to the shunt tank 38. It is understood that the shunt inlet 36 may comprise and/or may be referred to as, for example, a vent line, a standpipe, and/or any other known shunt system component. Likewise, shunt valve 40 may comprise and/or may be referred to as, for example, a pressure relief cap of the shunt system 39. The shunt system 39 may be configured to store a predetermined and/or variable amount of air that may have become entrained in the coolant of coolant system 12 due to turbulent flow of such coolant. The shunt system 39 may also be configured to provide a storage space for excess coolant provided to the heat exchanger 22 during operation.

Figure 8:
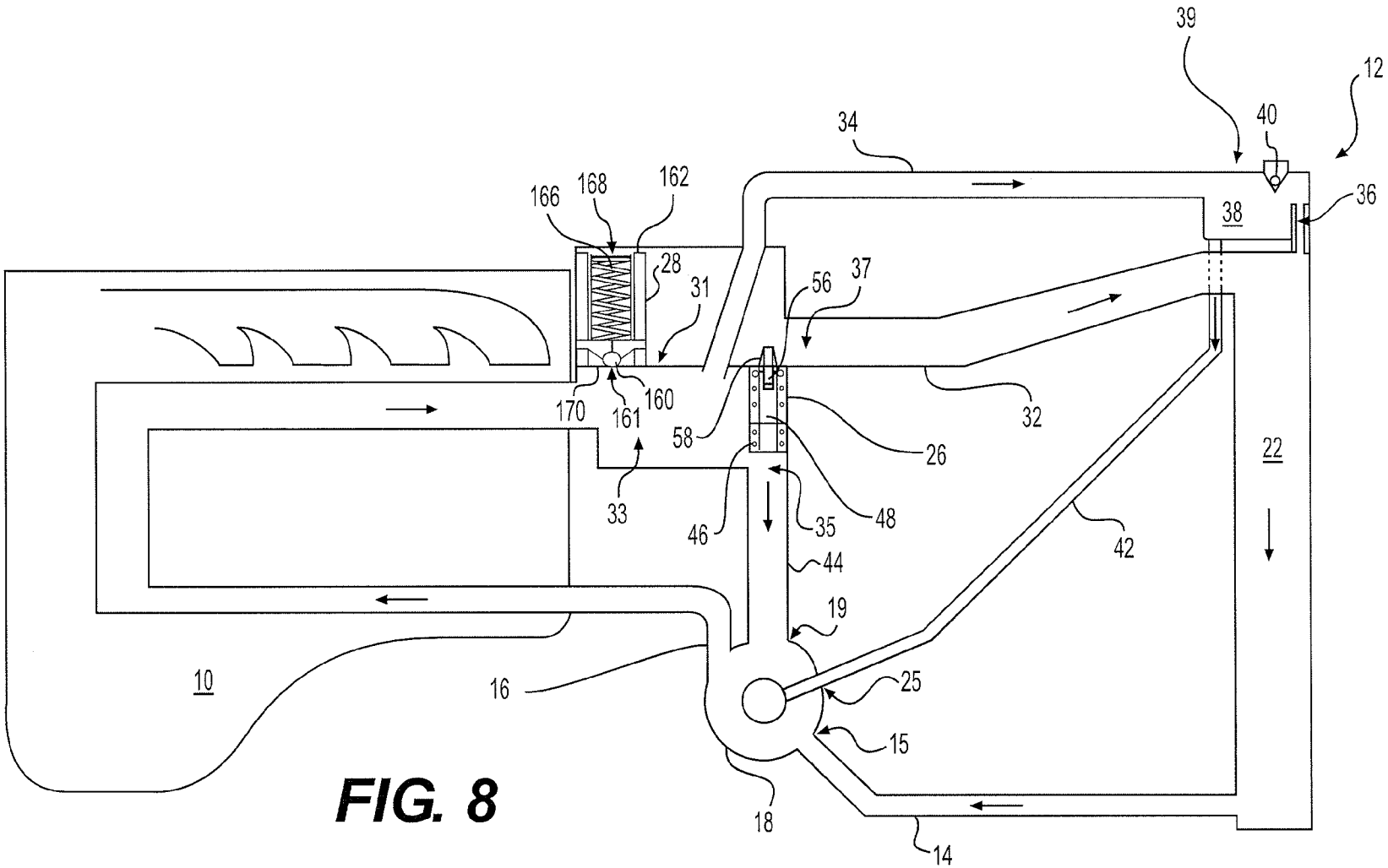
FIG. 8 is a schematic illustration of another exemplary disclosed engine cooling system that may be used in conjunction with the machine of FIG. 1.

As shown in FIG. 2, shunt tank 38 may be fluidly connected to the flow passage 31 via the engine vent line 34, and to the heat exchanger 22 via shunt inlet 36. As shown in FIG. 8, in additional exemplary embodiments, shunt tank 38 may be fluidly connected to inlet passage 33 via the engine vent line 34. In such an embodiment, engine vent line 34 may be configured to vent the engine side of thermostat 46. With continued reference to FIG. 2, the shunt tank 38 may also be fluidly connected to the pump 18 via the shunt line 42. In exemplary embodiments, the shunt tank 38 may be configured to collect and/or store air entrained in coolant received from the engine 10. Such air may pass to the shunt tank 38 via engine vent line 34. Collection and/or storage of such entrained air may, for example, enable coolant to pass to the engine 10 more efficiently, and may avoid the passage of such air back to engine 10 as coolant is passed from heat exchanger 22 to engine 10. Additionally, if coolant disposed within heat exchanger 22 increases in volume as a result of thermal expansion, at least some of the coolant may be diverted from the heat exchanger 22 to the shunt tank 38 via shunt inlet 36. For example, such coolant may be directed to the shunt tank 38 if a maximum coolant capacity of the heat exchange 22 is reached. Shunt tank 38 may have any desired capacity to facilitate storage of such air and/or coolant. In exemplary embodiments, shunt tank 38 may be sized and/or otherwise configured to store between approximately 10 percent and approximately 30 percent of the total volume of coolant utilized by cooling system 12.

Shunt valve 40 may comprise a check valve, a diaphragm valve, and/or any other like flow control device. In a first exemplary embodiment, shunt valve 40 may be biased, via a spring and/or other like resistance component, in a closed position. In such embodiments, shunt valve 40 may remain in the closed position until pressure within shunt tank exceeds a pressure threshold of shunt valve 40. Upon reaching such a pressure threshold, shunt valve 40 may transition to an open position and, for example, air collected and/or stored within shunt tank 38 may be released from shunt system 39 via shunt valve 40. In further exemplary embodiments, one or more additional vapor-liquid separators may be fluidly connected to shunt valve 40 and/or shunt tank 38 to assist in separating entrained air from the coolant stored therein. Such additional vapor-liquid separators may be configured to assist shunt valve 40 in releasing air collected and/or stored within shunt tank 38. In this manner, the shunt valve 40 may be configured to assist in regulating fluid pressure of the cooling system 12, and may be configured to prevent excessive pressures that would otherwise damage the heat exchanger 22 and/or other cooling system components. Additionally, by maintaining the coolant at an elevated pressure less than the pressure threshold of the shunt valve 40, the shunt valve 40 may assist in raising the boiling point of the coolant and may allow for more efficient operation of the engine 10. In exemplary embodiments, the pressure threshold of shunt valve 40 may be between approximately 10 psi and approximately 40 psi, and in further exemplary embodiments, such a threshold pressure may be between approximately 15 psi and approximately 20 psi.

Shunt line 42 may be a conduit similar to flow passage 14, bypass passage 44, returning passage 16, flow passage 32, and/or engine vent line 34 described above, and may be configured to transport deaerated coolant from shunt tank 38, at an elevated pressure, to the third inlet 25 of pump 18. The flow of coolant from shunt tank 38, through shunt line 42, into pump 18 may help to prevent pump cavitation by maintaining a positive pressure head of coolant at the pump 18. Cavitation of pump 18 may occur if, for example, a net inlet pressure in the pump 18 drops below a vapor pressure of the coolant. Providing a flow of pressurized coolant to pump 18 via shunt line 42 may increase the net inlet pressure of pump 18, and may thereby minimize such cavitation.

The shock-reducing valve 28 may be configured to minimize and/or substantially eliminate thermal shock caused by a sudden flow of relatively high temperature coolant from engine 10 to heat exchanger 22 via thermostat 26. As shown in FIGS. 2-4, in exemplary embodiments, the shock-reducing valve 28 may comprise a check valve, a diaphragm valve, and/or any other like flow control device configured to selectively permit a flow of fluid in a first direction and to substantially prohibit the flow of fluid in a second direction opposite the first direction. Shock-reducing valve 28 may be fluidly connected to engine 10 via inlet passage 33, and to heat exchanger 22 via flow passage 31. In exemplary embodiments, shock-reducing valve 28 may be located between engine 10 and heat exchanger 22, and may be configured to selectively direct a flow of heated coolant from engine 10 to heat exchanger 22 when the pressure of coolant passing into inlet passage 33 exceeds a pressure threshold associated with shock-reducing valve 28. It is contemplated that the threshold pressure of shock-reducing valve 28 may be any desired pressure, and may be between, for example, approximately 1 psi and approximately 25 psi. In still further exemplary embodiments, such a threshold pressure may be between approximately 5 psi and approximately 10 psi.

Shock-reducing valve 28 may include, among other things, a valve element 160, a seat 170, and a valve spring 166 configured to apply a biasing force to valve element 160. In exemplary embodiments, the biasing force applied by valve spring 166 may be sufficient to hold valve element 160 against seat 170, and to thereby substantially prohibit fluid from passing through an opening 161 in seat 170. For example, as shown in FIG. 2, when the fluid pressure of coolant entering inlet passage 33 from engine 10 is less than or equal to the threshold pressure of shock-reducing valve 28, the shock-reducing valve 28 may be arranged in a flow-blocking position substantially prohibiting the flow of coolant from the inlet passage 33 to the flow passage 31. In such a position, for example, valve element 160 may be biased against and/or fully seated within seat 170 such that opening 161 is substantially blocked by the valve element 160.

Shock-reducing valve 28 may further include one or more passages 168 fluidly connected to opening 161 and to flow passage 31. As shown in FIGS. 3 and 4, during operating conditions in which the fluid pressure of coolant entering inlet passage 33 from engine 10 is greater than the threshold pressure of the shock-reducing valve 28, the shock-reducing valve 28 may be arranged in a flow-passing position permitting coolant to pass from the inlet passage 33 to the flow passage 31. In such a position, the fluid pressure of the coolant may overcome the biasing force provided by valve spring 166. As a result, valve element 160 may be lifted from seat 170, thereby fluidly connecting inlet passage 33 with passages 168 via opening 161. As described above, in exemplary embodiments, the shock-reducing valve 28 may comprise a variable position valve. Alternatively, in further embodiments, the shock-reducing valve 28 may be a multi-position valve having one or more intermediate flow positions. Such intermediate flow positions may be achieved based on increasing or decreasing fluid pressures of the coolant entering inlet passage 33.

The flow of coolant directed to heat exchanger 22 by way of shock-reducing valve 28 may comprise a relatively small percentage of the total amount of coolant directed to inlet passage 33 from engine 10, and such a flow may be referred to herein as a "reduced" flow of coolant and/or a "portion" of the flow of coolant. In exemplary embodiments, the reduced flow of coolant may comprise between approximately 1 percent and approximately 20 percent of the total flow of coolant entering inlet passage 33 from engine 10. In further exemplary embodiments, the reduced flow of coolant may comprise between approximately 1 percent and approximately 5 percent of the total flow of coolant entering inlet passage 33 from engine 10. While thermostat 26 is in the first flow-blocking position, the reduced flow of coolant directed to heat exchanger 22 by shock-reducing valve 28 may be at an elevated temperature relative to coolant within the heat exchanger 22. Thus, the reduced flow of coolant directed by the shock-reducing valve 28 to the heat exchanger 22 may moderately increase the temperature of and/or otherwise condition the heat exchanger 22 before a remainder of the coolant exiting engine 10 via inlet passage 33 passes to the heat exchanger 22 via the thermostat 26 (in the second flow-blocking position). In exemplary embodiments, the shock-reducing valve 28 may be configured to facilitate a more gradual temperature increase of the heat exchanger 22 as compared to a relatively sudden temperature increase that may occur if coolant were only provided to the heat exchanger 22 via the thermostat 26 in the second flow-blocking position. In exemplary embodiments, the shock-reducing valve 28 may be may be connected in parallel with the thermostat 26, and as shown in FIGS. 2-4, the shock-reducing valve 28 may be located upstream of the thermostat 26 relative to engine 10 and/or heat exchanger 22.

Shock-reducing valve 28 may also be configured to allow passage of air to shunt system 39 while obstructing the passage of coolant thereto. In such embodiments, shock-reducing valve 28 may include one or more air passages 162 fluidly connecting inlet passage 33 with flow passage 31 and/or engine vent line 34. Such air passages 162 may be configured to permit passage of air to shunt system 39 in relatively low-pressure and/or low coolant flow conditions, such as when the fluid pressure of coolant entering inlet passage 33 from engine 10 is less than or equal to the pressure threshold of shock-reducing valve 28. In exemplary embodiments, air passages 162 may include respective check valves (not shown) and/or other like flow control devices configured to permit flow in a first direction while prohibiting flow in a second direction opposite the first. For example, such check valves may permit the flow of air from inlet passage 33 to flow passage 31, but may prohibit the flow of liquid coolant from flow passage 31 to inlet passage 33. For example, in the flow-blocking position of shock-reducing valve 28 shown in FIG. 2, valve element 160 may be in contact with seat 170 to substantially block the flow of coolant entering inlet passage 33 from engine 10. In such a configuration, air entrained in coolant entering inlet passage 33 from engine may collect within inlet passage 33, and may pass to flow passage 31 and/or engine vent line 34 via such air passages 162. In the flow-passing position of shock-reducing valve 28 shown in FIGS. 3 and 4, on the other hand, coolant entering inlet passage 33 from engine 10, as well as air collected in inlet passage 33, may pass to flow passage 31 via passage 168 and/or air passages 162.

Figure 5:
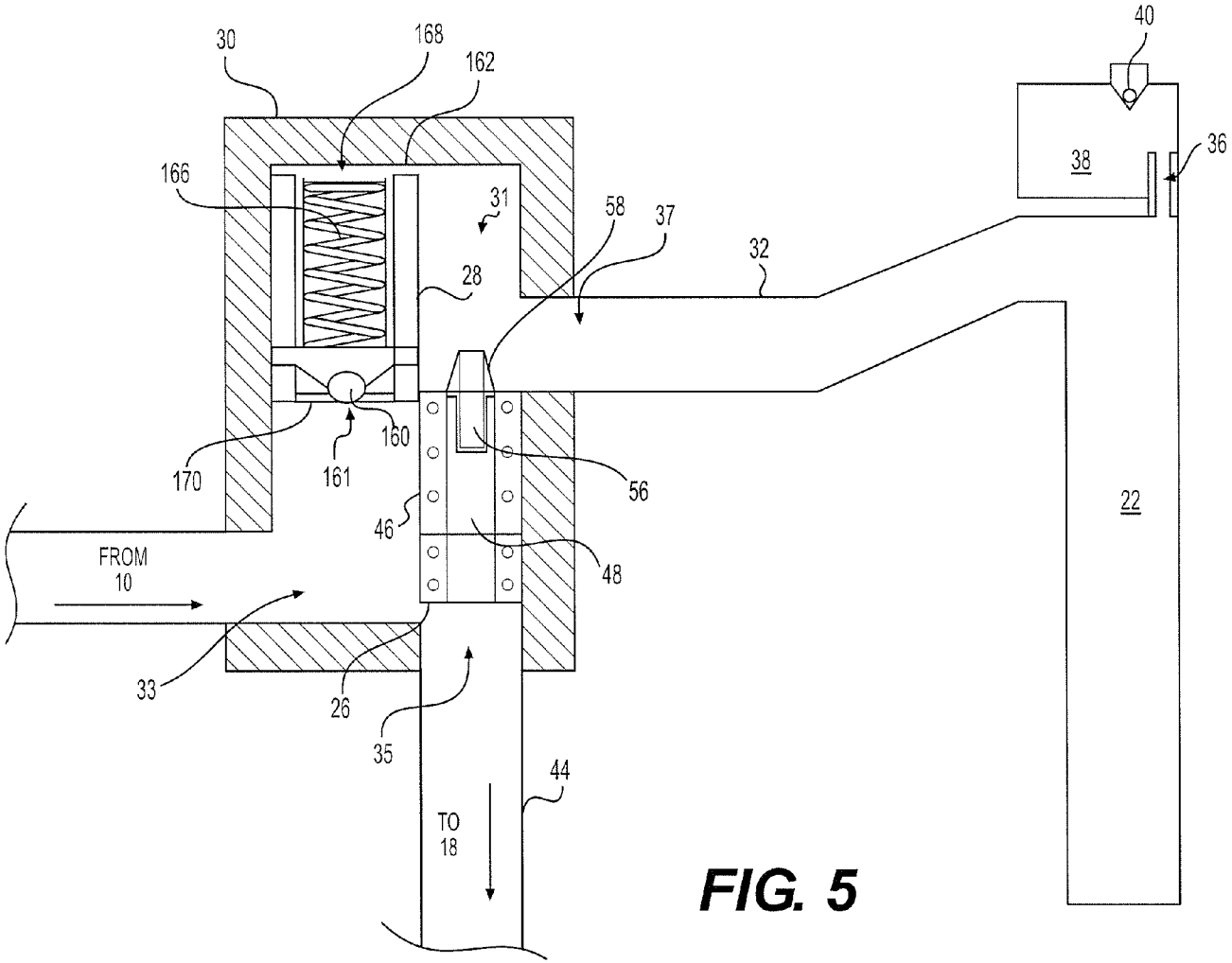
FIGS. 5-7 are cross-sectional illustrations of another exemplary disclosed valve configuration that may be used in conjunction with the cooling system of FIG. 2.
Figure 6:
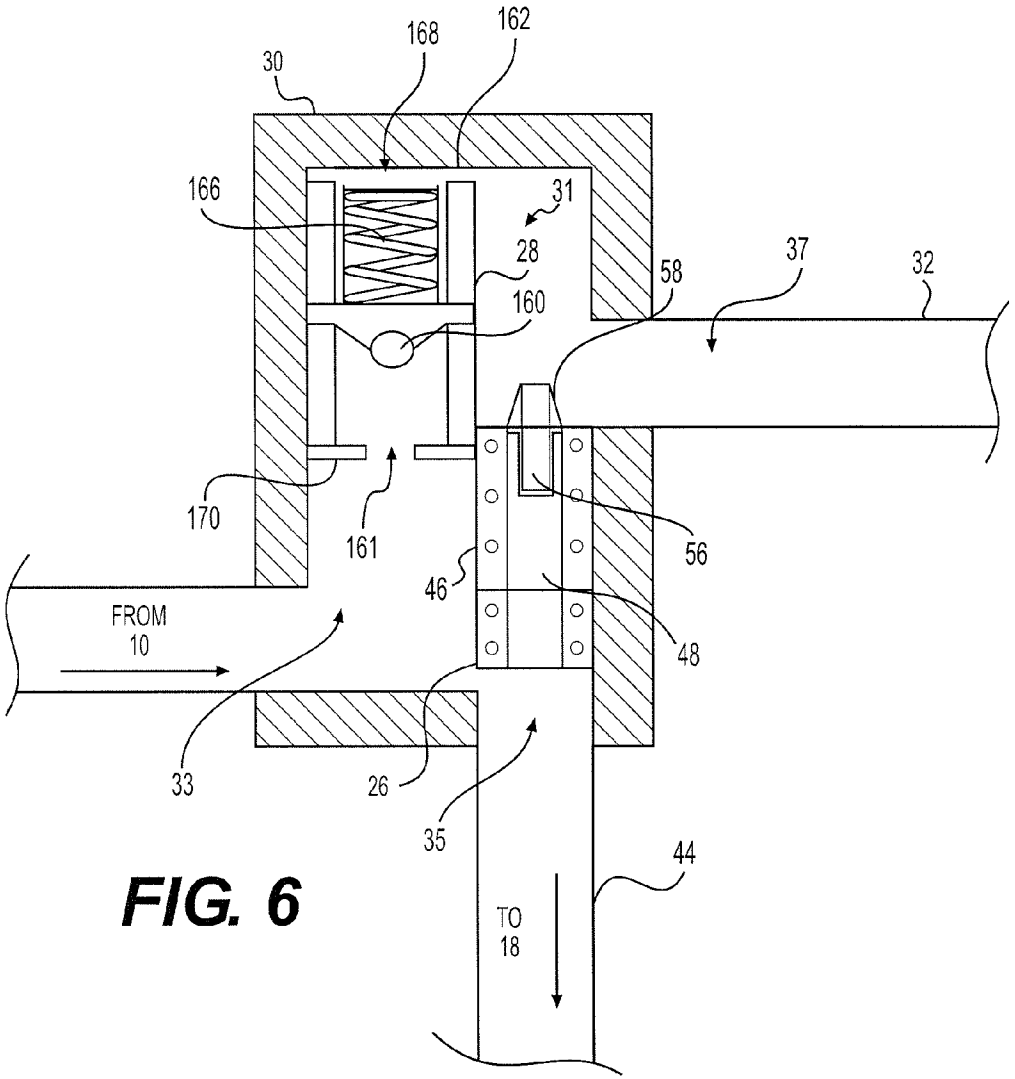
Figure 7:
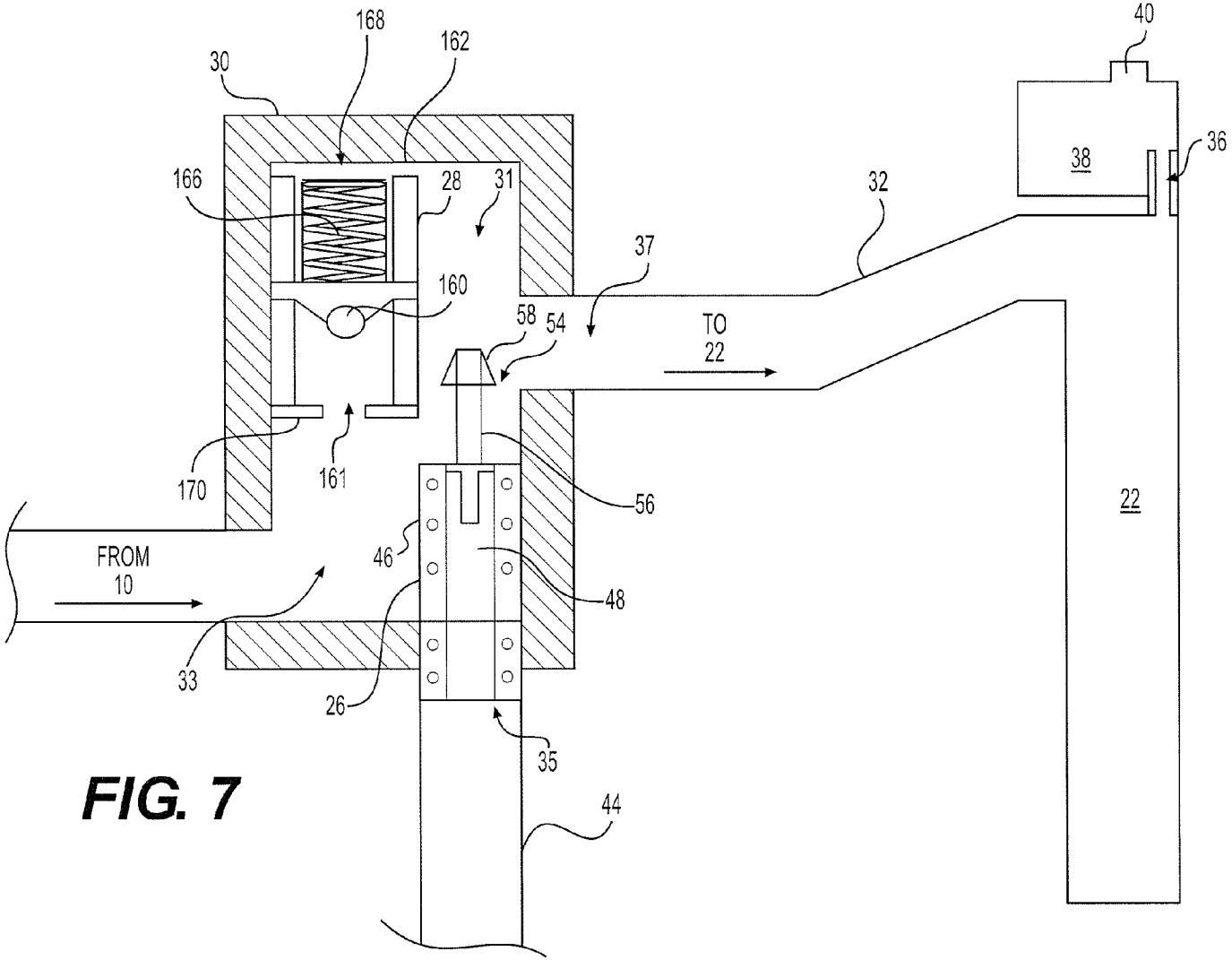

As shown in FIGS. 5-7, in still further exemplary embodiments the shock-reducing valve 28 and the thermostat 26 may be disposed within and/or otherwise fluidly connected to a common housing 30. In such embodiments, the housing 30 may comprise flow passage 31 described above as well as inlet passage 33. Additionally, in such embodiments, the thermostat 26 and the shock-reducing valve 28 may be disposed substantially in parallel with each other between inlet passage 33 and flow passage 31. It is contemplated that in the embodiment shown in FIGS. 5-7, air passages 162 of shock-reducing valve 28 may be configured to vent air from the engine 10 to the shunt tank 38 via flow passage 32. Accordingly, in such embodiments, the engine vent line 34 may be omitted. FIG. 5 illustrates the shock-reducing valve 28 in the flow-blocking position, and the thermostat 26 in the first flow-blocking position described above with respect to FIGS. 2 and 3. FIG. 6 illustrates the shock-reducing valve 28 in the flow-passing position and the thermostat 26 in the first flow-blocking position. FIG. 7 illustrates the shock-reducing valve 28 in the flow-passing position, and the thermostat 26 in the second flow-blocking position described above with respect to FIG. 4.

INDUSTRIAL APPLICABILITY

The disclosed cooling system 12 may be used in any machine or power system application in which it is beneficial to tightly control engine temperatures. The disclosed cooling system 12 may be used for land-based applications such as construction, farming, mining, drilling, and/or general transportation and marine applications, in which water from the marine environment may used for cooling purposes. The disclosed cooling system 12 may provide cooling of both air and coolant that enters or bypasses the engine 10. The disclosed cooling system 12 may provide an effective solution to engine cooling while minimizing thermal strain on the heat exchanger 22. Such a reduction in thermal strain may extend the useful life of the heat exchanger 22 and the various components of the cooling system 12 fluidly connected thereto. The operation of cooling system 12 will now be described with respect to FIGS. 2-4. It is understood that operation of the components of cooling system 12 illustrated in FIGS. 5-7 may be substantially similar to that of the cooling system components illustrated in FIGS. 2-4, except for the omission of engine vent line 34. Accordingly, for the duration of this disclosure, operation of the cooling system 12 shown in FIGS. 2-4 will be discussed unless otherwise specified.

During and/or shortly after startup of engine 10, the temperature of coolant disposed in heat exchanger 22 and/or exiting the engine 10 may be approximately equal to ambient temperature. Additionally during and/or shortly after startup, the fluid pressure of coolant exiting engine 10 may be relatively low. For example, in such conditions, the temperature of the coolant entering inlet passage 33 from the engine 10 may be less than or equal to the threshold temperature of thermostat 26, and the fluid pressure of such coolant may be less than or equal to the threshold pressure of shock-reducing valve 28. Such an operating condition of the cooling system 12 is illustrated in FIG. 2. In particular, during such an operating condition, the shock-reducing valve 28 may be in the flow-blocking position, and as a result, the coolant entering inlet passage 33 may be prohibited from passing to the flow passage 32 via the opening 161 of the shock-reducing valve 28. Additionally, as shown in FIG. 2, in such an operating condition the thermostat 26 may be in the first flow-blocking position. As a result, the coolant entering inlet passage 33 may be prohibited from entering the flow passage 32 via the one or more openings 54 (FIG. 4) proximate the top 58 of the thermostat 26. Instead, flow element 46 may be positioned to substantially block such openings 54 of thermostat 26. At the same time, flow element 46 may permit the coolant entering inlet passage 33 to flow into bypass passage 44 via inlet 35. Additionally, in such an operating condition, substantially no coolant may be permitted to flow into the shunt tank 38 via engine vent line 34 and/or flow passage 32. Air collected and/or otherwise disposed in inlet passage 33 may, however, be permitted to flow to engine vent line 34, and on to shunt tank 38, via air passages 162 of the shock-reducing valve 28. The operating condition illustrated in FIG. 2 may be referred to as a "low pressure, low temperature" operating condition of cooling system 12.

In such a low pressure, low temperature operating condition, substantially all of the coolant exiting engine 10 may be directed to the bypass line 44, and such coolant may pass to pump 18 via the second inlet 19. Such coolant may be pressurized by the pump 18, and may be returned to the engine 10 via the returning passage 16. As the coolant cycles through the engine 10, the coolant may assist in reducing the temperature of relatively high-temperature components of the engine 10 by absorbing heat therefrom. For example, coolant cycled through the engine 10 may assist in absorbing heat from and/or otherwise cooling the engine block, the external walls of the cylinders, the cylinder heads of engine 10, and/or other such components, through known convective heat transfer processes.

Due to, among other things, operation of the pump 18, the fluid pressure of the coolant cycling through engine 10 may increase over time. Additionally, as heat is transferred to such coolant, the temperature of the coolant may increase. In an exemplary embodiment, the fluid pressure of the coolant may exceed the pressure threshold of the shock-reducing valve 28 before the temperature of the coolant exceeds the temperature threshold of thermostat 26. For example, the pressure threshold of the shock-reducing valve 28 may be exceeded at elevated engine speeds. Such engine speeds may be between, for example, approximately 1500 rpm and approximately 8000 rpm, and such speeds may depend upon, among other things, the size, type, and/or configuration of the engine 10. Such an operating condition of the cooling system 12 is illustrated in FIG. 3. In particular, during such an operating condition, the shock-reducing valve 28 may transition to the flow-passing position in response to the fluid pressure of the coolant entering inlet passage 33 exceeding the threshold pressure of the shock-reducing valve 28. As a result, a reduced flow of the coolant entering inlet passage 33 may be directed to the flow passage 32 via the opening 161 of the shock-reducing valve 28. The reduced flow of coolant may pass to the heat exchanger 22 and may begin to increase the temperature of relatively low-temperature coolant stored therein. The reduced flow of coolant may also assist in increasing the temperature of the heat exchanger 22 itself via known convective heat transfer processes. Additionally, as shown in FIG. 3, in such an operating condition the thermostat 26 may remain in the first flow-blocking position since the temperature of the coolant entering inlet passage 33 may be below the temperature threshold of thermostat 26. Accordingly, a remainder of the coolant entering inlet passage 33 may be prohibited from entering the flow passage 32 via the openings 54 (FIG. 4) of the thermostat 26. Instead, flow element 46 may direct the remainder of the coolant entering inlet passage 33 to flow into bypass passage 44 via inlet 35. Moreover, in the exemplary operating condition of FIG. 3, any excess coolant provided to heat exchanger 22 may be directed to the shunt tank 38 via the shunt inlet 36. The operating condition illustrated in FIG. 3 may be referred to as a "high pressure, low temperature" operating condition of cooling system 12.

As coolant continues to circulate through the engine 10 and absorb heat, the coolant may eventually exceed the threshold temperature of the thermostat 26. Such an elevation in temperature may cause expansion of the pellet 48 of the thermostat 26, and such expansion may result in the thermostat 26 transitioning from the first flow-blocking position to the second flow-blocking position. In particular, expansion of the pellet 48 may cause flow element 46 to move away from top 58, and in a direction toward the inlet 35 of the bypass passage 44. As described above, in the second flow-blocking position, the flow element 46 may substantially block fluid communication between the bypass passage 44 and the inlet passage 33. At the same time, the flow element 46 may permit fluid communication between the flow passage 32 and the inlet passage 33 via, for example, the one or more openings 54 of the thermostat 26. Such an operating condition of the cooling system 12 is illustrated in FIG. 4. In particular, during such an operating condition, the shock-reducing valve 28 may remain in the flow-passing position such that the reduced flow of the coolant entering inlet passage 33 may be directed to the flow passage 32 via the opening 161 of the shock-reducing valve 28. Additionally, as shown in FIG. 4, in such an operating condition the thermostat 26 may be in the second flow-blocking position directing the remainder of the coolant entering inlet passage 33 to flow into the flow passage 32. Accordingly, the reduced flow and the remainder of the coolant may pass to the heat exchanger 22, and the heat exchanger 22 may assist in cooling the coolant before such coolant passes to the pump 18. Moreover, in the exemplary operating condition of FIG. 4, any excess coolant provided to heat exchanger 22 may be directed to the shunt tank 38 via the shunt inlet 36. The operating condition illustrated in FIG. 4 may be referred to as a "high pressure, high temperature" operating condition of cooling system 12. In further exemplary embodiments, it is contemplated that once the coolant temperature exceeds the temperature threshold of the thermostat 26, flow through the shock-reducing valve 28 may be substantially obstructed such that all coolant may flow through thermostat 26, at all coolant pressures, if desired.

In the event that the fluid pressure of the coolant entering inlet passage 33 from the engine 10 falls below the pressure threshold of shock-reducing valve 28 and the coolant temperature remains above the temperature threshold of thermostat 26, the shock-reducing valve 28 may transition to the flow-blocking position while the thermostat 26 may remain in the second flow-blocking position. During such a "low pressure, high temperature" operating condition, substantially all of the coolant entering inlet passage 33 from the engine 10 may be directed to the flow passage 32 via the thermostat 26. In such an operating condition of the cooling system 12, the thermostat 26 may substantially prohibit the flow of coolant from entering the bypass passage 44, and the shock-reducing valve 28 may substantially prohibit the flow of coolant from entering the flow passage 31.

Additionally, in operating conditions in which the ambient temperature is relatively high, it is contemplated that the temperature of the coolant entering the inlet passage 33 may exceed the temperature threshold of the thermostat 26 before the fluid pressure of the coolant entering the inlet passage 33 exceeds the pressure threshold of the shock-reducing valve 28. Such operating conditions may exist, for example, at relatively low engine speeds, and during such operating conditions, prewarming of the heat exchanger 22 by way of the reduced flow may not occur. In such operating conditions, the thermal strain on the heat exchanger 22, and thus the need for prewarming, may be minimized because the difference between the ambient temperature and the temperature of the coolant and/or the heat exchanger 22 may be relatively small.

As a result of thermal expansion of the coolant, some of the coolant in the heat exchanger 22 and/or other components of the cooling system 12 may be diverted from the flow passage 32 into the shunt tank 38 via the shunt inlet 36. For example, if the capacity of the heat exchanger 22 is exceeded due to thermal expansion of the coolant, such excess coolant may be directed to the shunt tank 38 for storage. Additionally, during any of the operating conditions described herein, air that may have accumulated in the coolant due to turbulent flow may be stored and/or separated in the shunt tank 38. When the coolant pressure in the shunt tank 38 reaches the shunt tank threshold, the air may be vented out of cooling system 12 via shunt valve 40. As a result, deaerated coolant in the shunt tank 38 may circulate to the third pump inlet 25 of pump 18 via shunt line 42.

The cooling system 12 disclosed herein provides prewarming to the heat exchanger 22 to minimize or prevent thermal strain on the heat exchanger 22. This may be accomplished by directing the reduced flow of coolant to the heat exchanger 22 to condition the heat exchanger 22 before directing a full flow of hot coolant to the heat exchanger 22. In this manner, heat provided by the reduced flow of coolant may result in a more gradual temperature change at the heat exchanger 22 compared to the sudden temperature change that may occur in the absence of prewarming in prior art systems. As described above, this gradual temperature change may extend the useful life of the heat exchanger 22 and/or other components of the cooling system 12.

It will be apparent to those skilled in the art that various modifications and variations can be made to the disclosed cooling system without departing from the scope of the disclosure. Other embodiments of the cooling system will be apparent to those skilled in the art from consideration of the specification and practice of the cooling system disclosed herein. It is intended that the specification and examples be considered as exemplary only, with a true scope of the disclosure being indicated by the following claims and their equivalents.

What is claimed is:

1. A cooling system for an engine, comprising:

a pump driven by the engine and configured to circulate coolant through the engine;

a heat exchanger configured to receive coolant from the engine and to reduce a temperature of the coolant;

a thermostat fluidly connected to the engine and the heat exchanger, the thermostat configured to selectively direct coolant from the engine to the heat exchanger when a temperature of the coolant is greater than a temperature threshold of the thermostat, and to substantially block coolant from passing to the heat exchanger when the temperature of the coolant is less than or equal to the temperature threshold; and a valve fluidly connected to the engine and the heat exchanger, and connected in parallel with the thermostat, the valve configured to allow a portion of the coolant exiting the engine to pass through the valve to the heat exchanger during a first operating condition, wherein during the first operating condition, a pressure of the coolant exiting the engine is greater than a pressure threshold of the valve.

2. The cooling system of claim 1, wherein the thermostat and the valve are fluidly connected to the pump via a bypass line, and wherein during the first operating condition, a remainder of the coolant is directed to the pump by the thermostat via the bypass line in response to the temperature of the coolant exiting the engine being less than or equal to the temperature threshold.

3. The cooling system of claim 2, further including a second operating condition in which the temperature of the coolant exiting the engine is greater than the temperature threshold and the pressure of the coolant exiting the engine is greater than the pressure threshold of the valve, wherein during the second operating condition, the valve allows the portion of the coolant exiting the engine to pass through the valve to the heat exchanger in response to the pressure of the coolant exiting the engine being greater than the pressure threshold.

4. The cooling system of claim 3, wherein during the second operating condition, the thermostat directs the remainder of the coolant to the heat exchanger in response to one of expansion and contraction of a temperature-sensitive component of the thermostat.

5. The cooling system of claim 3, wherein during the second operating condition, the thermostat directs the remainder of the coolant exiting the engine to the heat exchanger, while substantially blocking passage of coolant from the engine to the pump via the bypass line, in response to the temperature of the coolant exiting the engine being greater than the temperature threshold.

6. The cooling system of claim 2, further including a second operating condition in which the pressure of the coolant exiting the engine is less than or equal to the pressure threshold, wherein during the second operating condition, the valve substantially blocks passage of the portion of the coolant from the engine to the heat exchanger in response to the pressure of the coolant exiting the engine being less than or equal to the pressure threshold.

7. The cooling system of claim 6, wherein during the second operating condition, the temperature of the coolant exiting the engine is less than or equal to the temperature threshold, wherein during the second operating condition, the thermostat directs the remainder of the coolant to the pump via the bypass line in response to the temperature of the coolant exiting the engine being less than or equal to the temperature threshold.

8. The cooling system of claim 1, wherein the portion of the coolant comprises between approximately 1% and approximately 5% of the coolant exiting the engine.

9. The cooling system of claim 1, further including a shunt system having a shunt tank fluidly connected to the heat exchanger, a shunt valve fluidly connected to the shunt tank, the shunt valve configured to vent air out of the shunt tank when a pressure in the shunt tank exceeds a shunt valve pressure threshold, and a shunt line fluidly connected to the shunt tank and the pump.

10. A cooling system for an engine, comprising:

a pump driven by the engine and configured to circulate coolant through the engine;

a heat exchanger configured to receive coolant from the engine and to reduce a temperature of the coolant;

a thermostat fluidly connected to the engine, the pump, and the heat exchanger, the thermostat configured to simultaneously direct coolant from the engine to the heat exchanger while substantially blocking passage of coolant from the engine to the pump when a temperature of the coolant is greater than a temperature threshold of the thermostat; and a valve fluidly connected to the engine and the heat exchanger, and connected in parallel with the thermostat, the valve configured to allow a portion of the coolant exiting the engine to pass through the valve to the heat exchanger when a pressure of the coolant is greater than a pressure threshold of the valve, and to substantially block passage of coolant to the heat exchanger when the pressure of the coolant is less than or equal to the pressure threshold.

11. The cooling system of claim 10, further including a shunt tank fluidly connected to the heat exchanger, the valve, and the thermostat, the shunt tank being configured to receive coolant from the heat exchanger.

12. The cooling system of claim 11, wherein the valve comprises an air passage configured to direct air collected from coolant exiting the engine to the shunt tank.

13. The cooling system of claim 11, wherein the shunt tank includes a shunt valve configured to release air stored in the shunt tank in response to a pressure within the shunt tank being greater than a pressure threshold of the shunt valve.

14. The cooling system of claim 11, wherein the heat exchanger is configured to direct coolant to a first inlet of the pump, the thermostat is configured to direct coolant to a second inlet of the pump, and the shunt tank is configured to direct coolant to a third inlet of the pump.

15. The cooling system of claim 10, wherein the temperature threshold is between approximately 80 degrees Celsius and approximately 90 degrees Celsius, and wherein the pressure threshold is between approximately 5 psi and approximately 20 psi.

16. The cooling system of claim 10, wherein the valve and the thermostat are disposed within a common housing, the housing being selectively fluidly connected to the pump, the engine, and the heat exchanger.

17. A method of cooling an engine, comprising:

receiving heated coolant from the engine;

allowing a portion of the coolant from the engine to pass through a valve to a heat exchanger during a first operating condition, in response to a pressure of the coolant being greater than a threshold pressure; and directing, by a thermostat connected in parallel with the valve, a remainder of the coolant to a pump during the first operating condition, in response to a temperature of the coolant being less than or equal to a threshold temperature.

18. The method of claim 17, further including directing the portion of the coolant to the heat exchanger, during a second operating condition different than the first operating condition, in response to the pressure of the coolant being greater than the threshold pressure, and directing the remainder of the coolant to the heat exchanger, during the second operating condition, in response to the temperature of the coolant being greater than the threshold temperature.

19. The method of claim 18, further including substantially blocking, with a thermostat, coolant from passing to the pump while simultaneously directing the remainder of the coolant to the heat exchanger with the thermostat.

20. The method of claim 17, further including substantially blocking the portion of the coolant from passing to the heat exchanger, during a second operating condition different than the first operating condition, in response to the pressure of the coolant being less than or equal to the pressure threshold, and directing the received coolant to the pump, during the second operating condition, in response to the temperature of the coolant being less than or equal to the temperature threshold.

* * * * *